US007114981B1

(12) United States Patent
Huang et al.

(10) Patent No.: US 7,114,981 B1
(45) Date of Patent: Oct. 3, 2006

(54) RECEPTACLE CONNECTOR WITH LATCH MECHANISM

(75) Inventors: Mao-Jung Huang, Tu-Cheng (TW); Te-Hung Yin, Tu-Cheng (TW); Ping-Chih Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/227,353

(22) Filed: Sep. 15, 2005

(51) Int. Cl.
*H01R 13/71* (2006.01)

(52) U.S. Cl. ..... 439/353; 439/108; 439/541.5; 439/609

(58) Field of Classification Search ..... 439/353, 439/108, 541.5, 609
See application file for complete search history.

(56) References Cited

U.S. PATENT DOCUMENTS 4,986,779 A * 1/1991 Ferrill et al. ..... 439/108
6,241,555 B1 * 6/2001 Okuyama et al. ..... 439/607
6,430,053 B1 * 8/2002 Peterson et al. ..... 361/728

* cited by examiner

*Primary Examiner*—Truc Nguyen

(57) ABSTRACT

A receptacle connector with latch mechanism includes a receptacle housing which has a mating face, a plurality of sidewalls defining a cavity opening to the mating face, and a plurality of contacts receiving chambers formed in the cavity, a plurality of contacts received in the chambers, and a shielding cover having a plurality of side panels enclosing the sidewalls of the receptacle housing. One sidewall defines a pair of slots opening to the mating face, thereby forming a cantilevered latch arm between the pair of slots. One side panel defines a pair of gaps corresponding to the pair of slots, thereby forming a cantilevered elastic slice between the gaps that acts coordinately with the cantilevered latch arm to latch a mating plug connector when the mating plug connector is inserted into the cavity of the receptacle housing.

3 Claims, 7 Drawing Sheets

RECEPTACLE CONNECTOR WITH LATCH MECHANISM

BACKGROUND OF THE INVENTION

1. Field of the Invention

The present invention generally relates to a receptacle connector, and more particular to a receptacle connector having a latch mechanism for securely and reliably connecting the receptacle connector to a mating plug connector.

2. The Related Art

Electrical connectors are widely applied in electrical connection systems. A reliable connection between a pair of mated electrical connectors is crucial to the system; otherwise electrical interruption may be frequently caused. To obtain a reliable connection, more and more connectors are designed to have latch mechanisms.

A conventional receptacle connector 300 as shown in FIG. 7 includes an insulating housing 11, a plurality of contacts 12 received in the insulating housing 11, and two-layered covers 13 and 14 enclosing the insulating housing 11. The inner cover 13 defines a plurality of elastic slices 131, and the outer cover 14 forms a plurality of apertures 141 corresponding to the elastic slices 131 of the inner cover 13. In assembling with a mating plug connector, free ends of the elastic slices 131 are biased in the apertures 141 respectively, therefore providing elastic engaging forces to latch the mating plug connector.

The engaging forces of the receptacle connector 300 as described above are achieved by adding the outer cover 14. However, on one hand, the added outer cover 14 increases cost of the receptacle connector 300. On the other hand, the engaging forces achieved by the elastic slices 131 and the apertures 141 structured as above are not strong enough to obtain a reliable connection between the receptacle connector 300 and the plug connector.

SUMMARY OF THE INVENTION

The present invention is directed to solving the above problems and provides a receptacle connector with latch mechanism. The receptacle connector with latch mechanism includes a receptacle housing which has a mating face, a plurality of sidewalls defining a cavity opening to the mating face, and a plurality of contact receiving chambers formed in the cavity, a plurality of contacts received in the chambers, and a shielding cover having a plurality of side panels enclosing the sidewalls of the receptacle housing. One sidewall defines a pair of slots opening to the mating face, thereby forming a cantilevered latch arm between the pair of slots. A free end of the latch arm forms a hook protruding inwardly into the cavity. One side panel defines a pair of gaps corresponding to the pair of slots, thereby forming a cantilevered elastic slice between the gaps that acts coordinately with the cantilevered latch arm to latch a mating plug connector when the mating plug connector is inserted into the cavity of the receptacle housing.

It can be seen from the mentioned-above that the engaging force between the receptacle connector and the plug connector is reinforced by designing the cantilevered latch arm and the cantilevered elastic slice that act coordinately with each other. Therefore a secure and reliable connection between the receptacle connector and the plug connector is achieved.

Other objects, novel features and advantages of the present invention will become more apparent from the following detailed description of a preferred embodiment thereof when taken in conjunction with the accompanying drawings.

DETAILED DESCRIPTION OF THE PREFERRED EMBODIMENT

In order to illustrate the present invention particularly, including technology, structure trait, aims and efficiency, a detailed explanation of a preferred embodiment of the present invention will be given thereinafter, with reference to the annexed drawings, for better understanding thereof to those skilled in the art.

Figure 1:
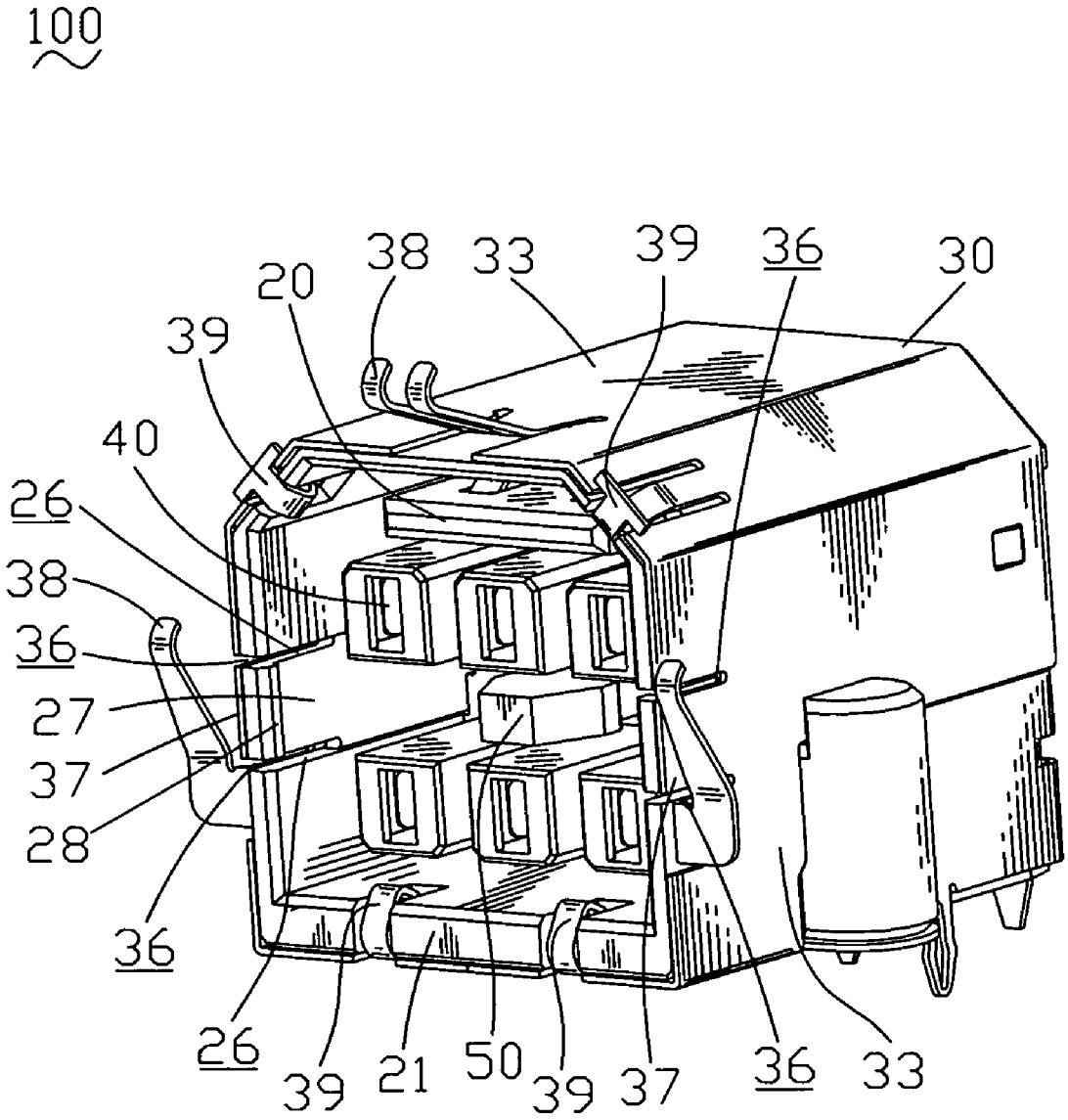
FIG. 1 is a perspective view of a receptacle connector in accordance with the present invention.

With reference to FIG. 1, a receptacle connector 100 in accordance with the present invention comprises a receptacle housing 20, a plurality of electrical contacts 40 received in the receptacle housing 20, and a shielding cover 30 enclosing the receptacle housing 20.

Figure 2:
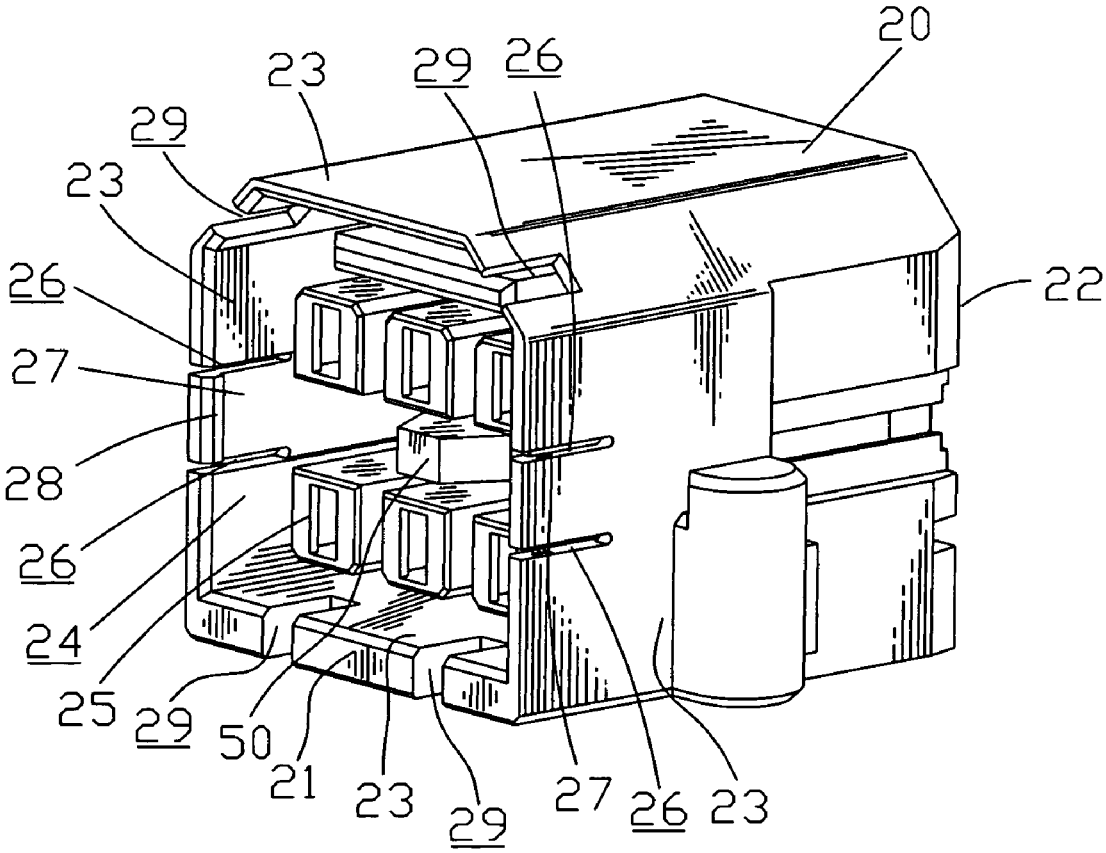
FIG. 2 is a perspective view of a receptacle housing of the receptacle connector shown in FIG. 1.

Referring to FIG. 2, the receptacle housing 20 has a mating face 21, a connecting face 22 opposite to the mating face 21, a plurality of sidewalls 23 which define a cavity 24 opening to the mating face 21, and a plurality of contact receiving chamber 25 formed in the cavity 24 for receiving the electrical contacts 40 respectively. A buckle mechanism 50 formed in the cavity 24 as a whole extends towards the mating face 21. The left sidewall and the opposite right sidewall 23 each define a pair of slots 26 opening to the mating face 21, thereby forming a cantilevered latch arm 27 between the pair of slots 26. A hook 28 formed at the free end of each latch arm 27 protrudes inwardly into the cavity 24. The receptacle housing 20 further defines a plurality of notches 29 in the upper and lower sidewalls 23.

Figure 3:
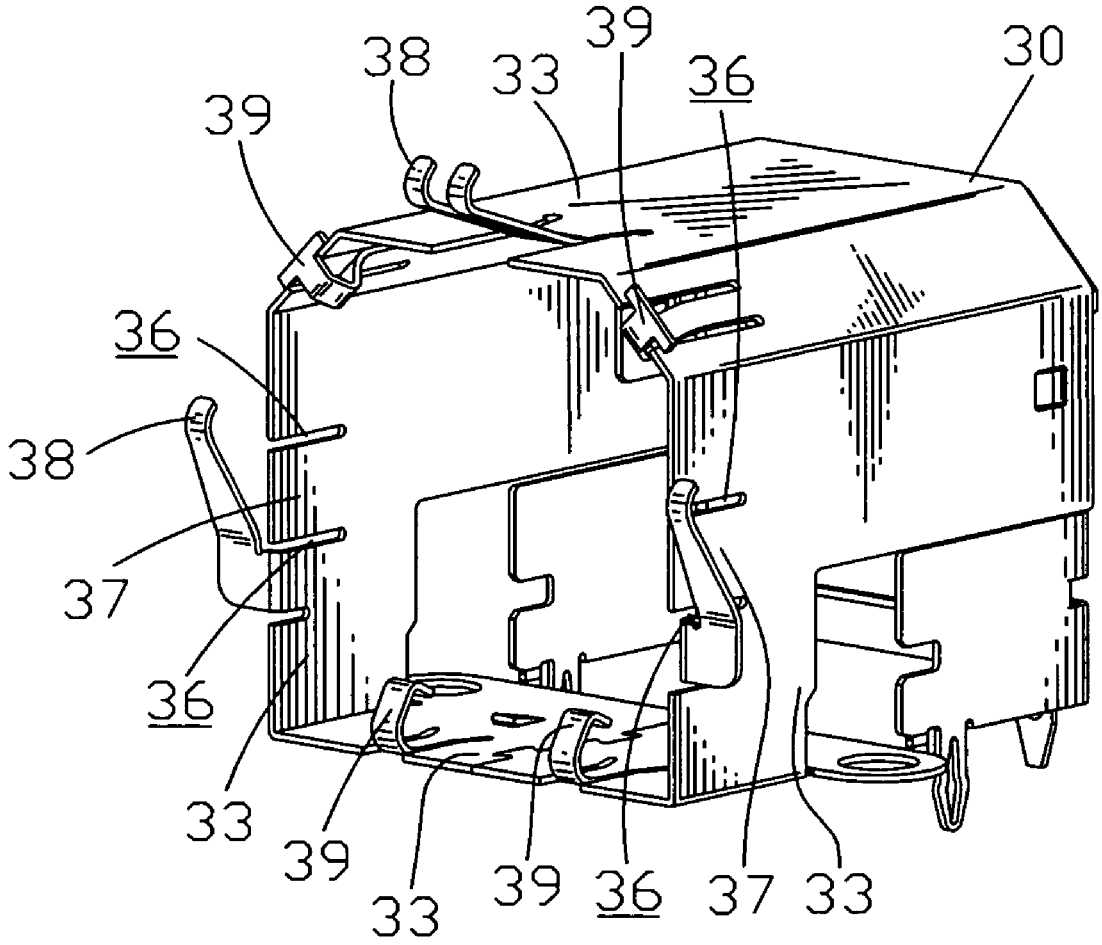
FIG. 3 is a perspective view of a shielding cover of the receptacle connector shown in FIG. 1.

The shielding cover 30 as shown in FIG. 3 has a plurality of side panels 33 which enclose the sidewalls 23 of the receptacle housing 20. The left side panel and the opposite right side panel 33 each define a pair of gaps 36 corresponding to the pair of slots 26, thereby forming a cantilevered elastic slice 37 between the gaps 36. The length of the gaps 36 and the cantilevered elastic slice 37 are equal to the length of the slots 26 and the latch arm 27. The shielding cover 30 further defines a plurality of grounding tabs 39 curved inwardly from the upper and lower side panels 33 and a plurality of spring tabs 38 extending sideward from the left and right side panels 33 and further extending forward.

Please refer to FIG. 1 again. In the assemble of the receptacle housing 20 with the shielding cover 30, the side panels 33 of the shielding cover 30 enclose the sidewalls 23 of the receptacle housing 20. The grounding tabs 39 respectively extend into the cavity 24 through the notches 29 of the receptacle housing 20. The gaps 36 overlap on the slots 26 respectively, and the cantilevered elastic slices 37 overlap on the cantilevered latch arms 27 respectively so that the cantilevered elastic slices 37 and the respective cantilevered latch arms 27 are able to act coordinately with each other. The spring tabs 38 extend forward beyond the mating face 21.

Figure 4:
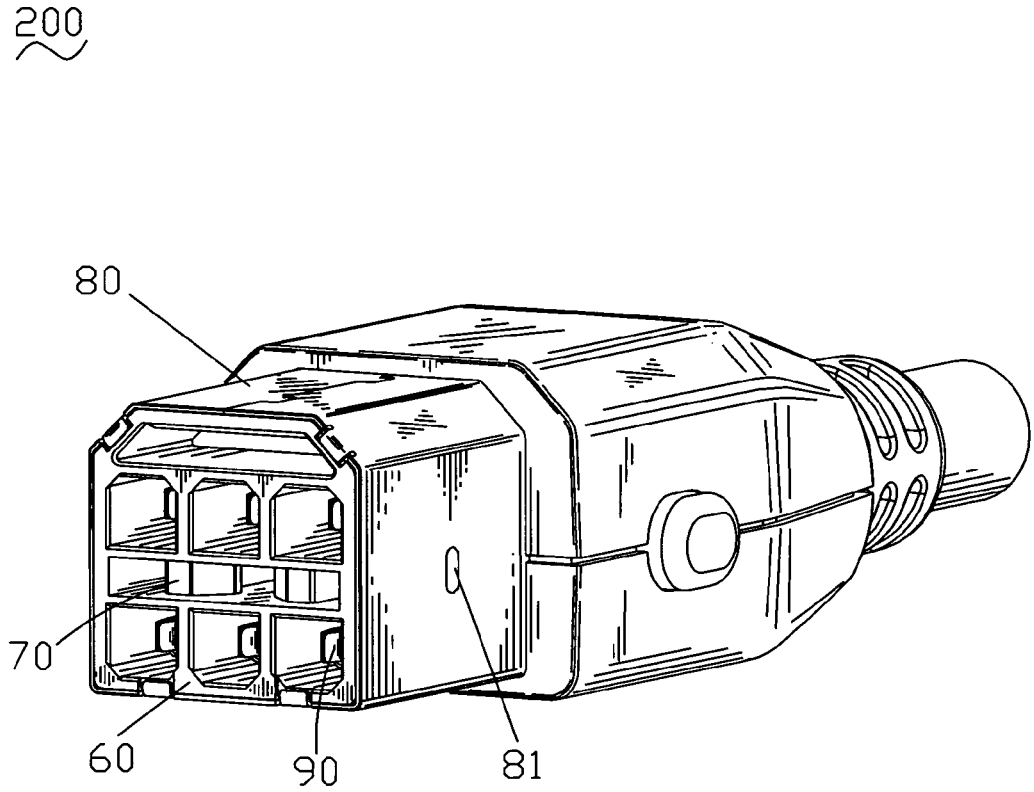
FIG. 4 is a perspective view of a plug connector for mating with the receptacle connector.

FIG. 4 clearly shows a plug connector 200 which mates with the receptacle connector 100. The plug connector 200 comprises a plug housing 60, a plurality of contacts 90 and a hook mechanism 70 received in the plug housing 60, and a metal cover 80 encircling the sidewalls of the plug housing 60. The metal cover 80 defines a pair of protrusions 81 formed on left and right laterals of the metal cover 80.

Figure 5:
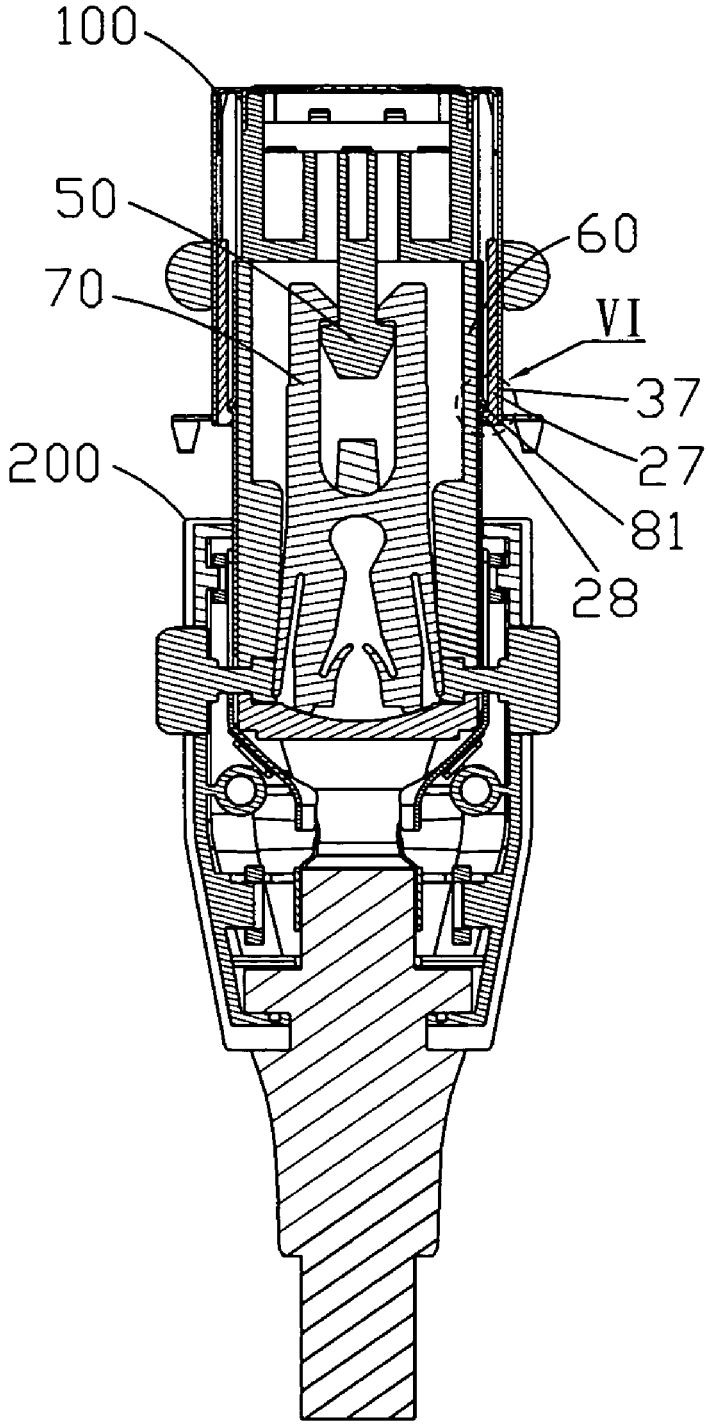
FIG. 5 is a cross-sectional view of the receptacle connector mating with the plug connector.
Figure 6:
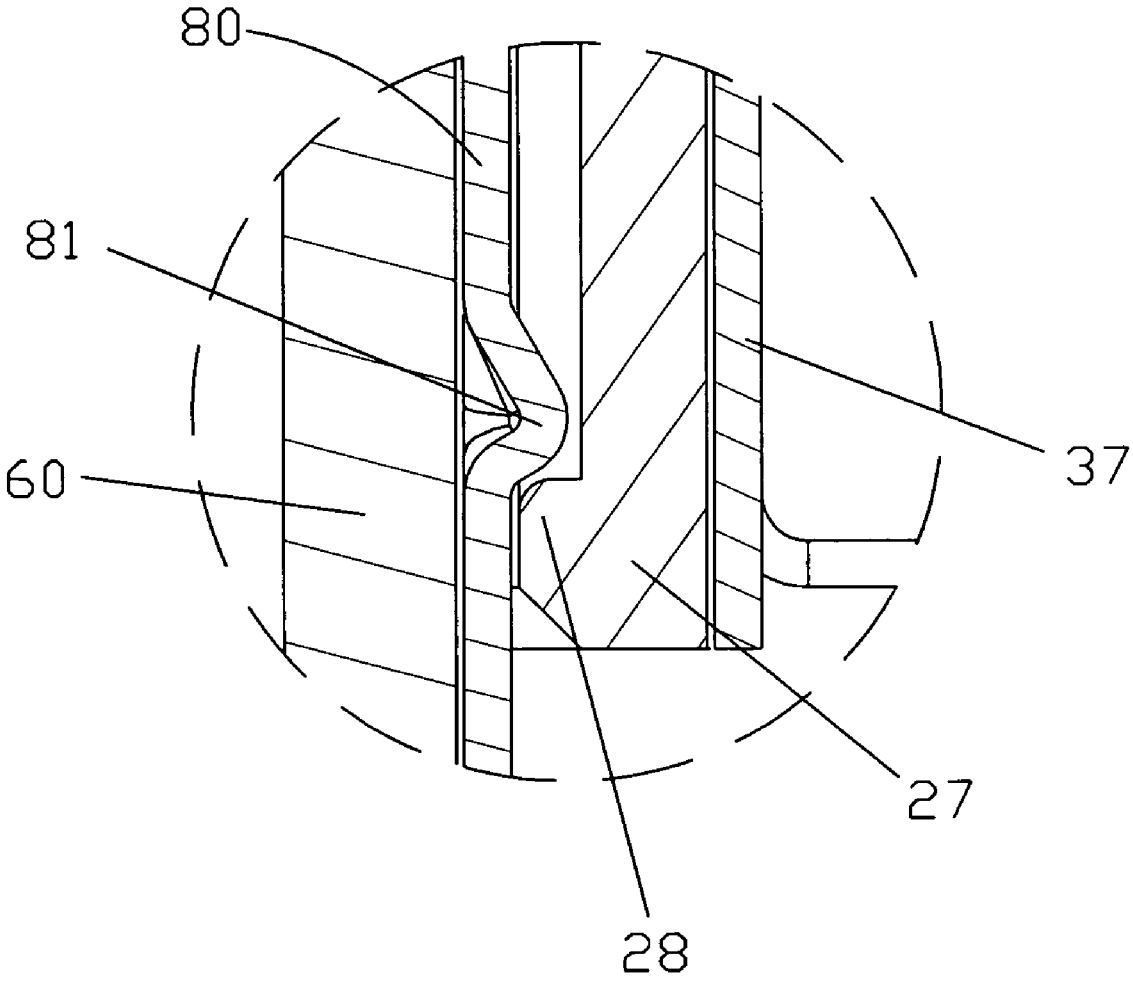
FIG. 6 is a partial enlarged view of the encircled portion VI of FIG. 5.
Figure 7:
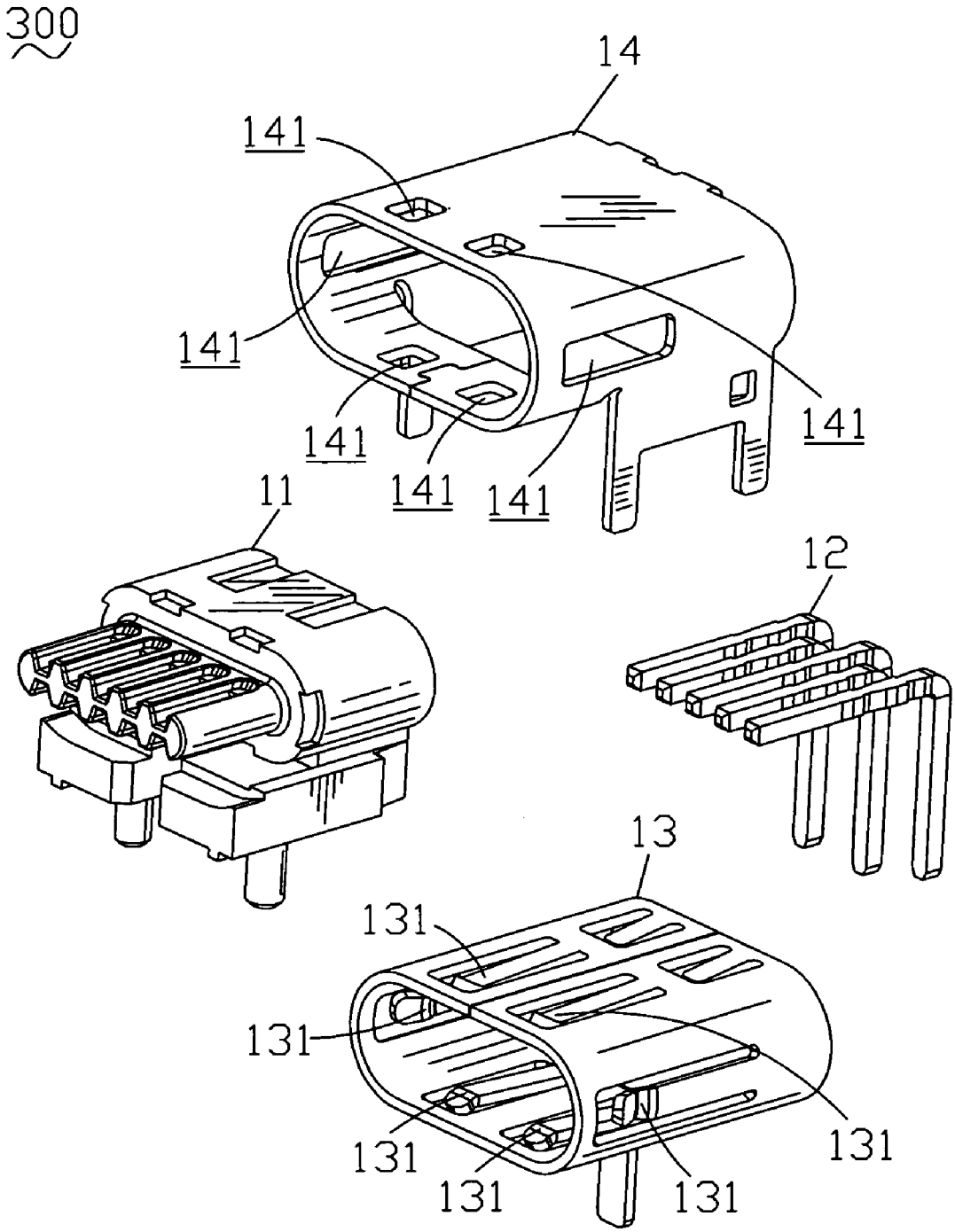
FIG. 7 (Prior Art)
FIG. 7 is an exploded view of a conventional connector.

Please refer to FIG. 5 now. When the receptacle connector 100 of the present invention mates with the plug connector 200, the buckle mechanism 50 of the receptacle connector 100 buckles with the hook mechanism 70 of the plug connector 200, and the cantilevered latch arms 27 together with the respective cantilevered elastic slices 37 are biased outwardly with the hooks 28 of cantilevered latch arms 27 buckling with the protrusions 81 of the plug connector 200. Thus the plug connector 200 is latched to the receptacle connector 100. The grounding tabs 39 press the sidewalls of the metal cover 80 for grounding the plug connector 200.

It can be seen from the mentioned-above that the engaging force between the receptacle connector 100 and the plug connector 200 is reinforced by designing the cantilevered latch arms 27 and the cantilevered elastic slice 37 that act coordinately with each other. Therefore a secure and reliable connection between the receptacle connector 100 and the plug connector 200 is achieved.

Although a preferred embodiment of the present invention has been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. A receptacle connector with latch mechanism comprising:

a receptacle housing having a mating face, a plurality of sidewalls defining a cavity opening to the mating face, and at least one contact receiving chamber formed in the cavity, at least one of said sidewalls defining a pair of slots opening to the mating face, thereby forming a cantilevered latch arm between the pair of slots, a free end of the latch arm forming a hook protruding inwardly into the cavity;

at least one electrical contact received in the contact receiving chamber; and a shielding cover having a plurality of side panels enclosing the sidewalls of the receptacle housing, at least one side panel defining a pair of gaps corresponding to the pair of slots, thereby forming a cantilevered elastic slice between the gaps that acts coordinately with the cantilevered latch arm to latch a mating plug connector when the mating plug connector is inserted into the cavity of the receptacle housing.

2. The receptacle connector with latch mechanism as claimed in claim 1, wherein the shielding cover is provided with at least one grounding tab curved inwardly from the side panel, and the insulating housing defines at least one notch in the sidewall corresponding to the grounding tab to permit the grounding tab to extend into the cavity therethrough.

3. The receptacle connector with latch mechanism as claimed in claim 1, wherein the shielding cover further has a plurality of spring tabs extending beyond the mating face.

* * * * *